US005687983A

United States Patent [19]

Feketa et al.

[11] Patent Number: 5,687,983

[45] Date of Patent: Nov. 18, 1997

[54] LIGHT WEIGHT BALLET SKIS AND METHOD OF MANUFACTURE

[75] Inventors: James Feketa, Sparta; Richard Gauer, Hewitt, both of N.J.

[73] Assignee: GSI, Inc., N.J.

[21] Appl. No.: 526,775

[22] Filed: Sep. 22, 1995

Related U.S. Application Data

[63] Continuation-in-part of Ser. No. 330,263, Oct. 27, 1994, Pat. No. 5,560,632.

[51] Int. Cl.[6] ..... A63C 5/025; A63C 5/04

[52] U.S. Cl. ..... 280/609; 280/610; 280/608

[58] Field of Search ..... 280/610, 609, 280/608, 600, 601

[56] References Cited

U.S. PATENT DOCUMENTS

| | | | |
|---|---|---|---|
| D. 339,398 | 9/1993 | Gauer . | |
| 3,372,943 | 3/1968 | Grossauer | 280/610 |
| 3,498,626 | 3/1970 | Sullivan | 280/610 |
| 3,635,482 | 1/1972 | Holman | 280/610 |
| 3,704,023 | 11/1972 | Downs | 280/610 |
| 4,705,291 | 11/1987 | Gauer . | |
| 5,299,822 | 4/1994 | Mayr et al. | 280/610 |
| 5,496,053 | 3/1996 | Abondance | 280/609 |

FOREIGN PATENT DOCUMENTS

| | | | |
|---|---|---|---|
| 2606655 | 11/1986 | France | 280/610 |

*Primary Examiner*—Brian L. Johnson
*Assistant Examiner*—Avraham Lerner
*Attorney, Agent, or Firm*—Anthony J. Casella; Gerald E. Hespos; Ludomir A. Budzyn

[57] ABSTRACT

A ski is provided with an internal support structure configured to ensure adequate strength for the ski. The internal support structure is formed to define at least one internal cavity. An outer shell surrounds the internal cavity and the internal support structure and defines the exterior of the ski. The internal support structure may be formed from opposed halves assembled to one another. The internal support structure may include a plurality of outwardly extending positioning legs formed unitarily therewith for positioning the internal support structure within an injection mold cavity. The ski may further be provided with metal edges snapped into grooves formed on portions of the bottom surface adjacent the sides.

10 Claims, 3 Drawing Sheets

LIGHT WEIGHT BALLET SKIS AND METHOD OF MANUFACTURE

This application is a continuation-in-part of U.S. patent application Ser. No. 08/330,263, filed Oct. 27, 1994, now U.S. Pat. No. 5,560,632.

BACKGROUND OF THE INVENTION

1. Field of the Invention

This invention relates to improvements in the field of ballet skis. The improvements relate to lighter weight skis and to more efficient methods of manufacturing skis.

2. Description of the Prior Art

The typical prior art snow ski is very long, narrow and thin. These prior art skis typically exhibit flexibility along their length, but assume a reversed camber in their unflexed condition. Thus, a ski that has its bottom placed on a flat surface will be supported by the front and rear of the ski. However, portions of the ski between the front and rear will be spaced upwardly from the flat surface. The bottom of the typical prior art snow ski is substantially flat from side-to-side at virtually all locations on the ski.

The prior art snow ski originally was made from a unitary piece of wood. More recently, however, skis have been made from laminates, with layers being secured to one another by adhesive activated under significant heat and pressure. In view of their narrow width and small thickness, the typical prior art snow ski has been fairly light weight despite its relatively long length.

The bottom of the typical prior art snow ski includes metallic edges extending along the opposed sides of the bottom. The metallic edges typically have tabs secured by adhesive between layers of the laminate to anchor the edges into the bottom of the ski.

Shorter versions of the above described prior art laminated snow skis have been developed primarily for novice skiers and children. These short prior art snow skis have width and thickness dimensions similar to the above described conventional prior art snow skis, and have the above described bottom that is flat from side-to-side.

Very effective prior art skis are shown in U.S. Pat. No. 4,705,291 and U.S. Design Pat. No. Des. 339,398 both of which issued to Richard Gauer, and in pending U.S. patent application Ser. No. 08/330,263 which was filed by Richard Gauer. Skis covered by these issued patents are sold under the GAUER trademark. The GAUER brand of skis are shorter, wider and thicker than the conventional prior art skis described above. Additionally, the GAUER skis are substantially inflexible. The bottom surface of the GAUER ski is substantially continuously arcuately convex from front to rear. Additionally, unlike the prior art skis that are substantially flat from side-to-side, the GAUER brand ski is convex from side-to-side. The specific shape of the convexity in a side-to-side direction was carefully designed by Richard Gauer to ensure control and maneuverability. As a result, skiers can perform balletic movements on these skis while skiing very fast down steep slopes.

Although the GAUER ski is very desirable, room for improvement exists. For example, the greater width and thickness of these skis leads to a ski that is fairly heavy for its length. Thus, a prior art GAUER ski with a length of 80 cm will weigh approximately the same as a conventional prior art ski having a length of 140–160 cm. Although the GAUER skis are not significantly heavier than their much longer counterparts, they give a perception of great weight due to their shorter length. This relatively greater weight is perceived as a problem when the skis are carried to and from the ski slope.

The greater thickness and width of the GAUER brand of skis also has presented inefficiencies during manufacture. In particular, U.S. Pat. No. 4,705,291 shows the ski manufactured as left and right channels assembled and then filled with a foam. Although the shape of ski shown in U.S. Pat. No. 4,705,291 has proved very desirable, the disclosed side channels and foam filler have manufacturing impracticalities. The ski shown in U.S. Design Pat. No. Des. 339,398 is depicted as being unitarily molded from a plastic material. The unitary plastic GAUER brand of ski has been manufactured in large quantities and has enjoyed commercial success. However the ski requires a long cycle time during injection molding due to the need to cool the wide and thick plastic ski prior to removal from the mold. Inadequate cooling could change the shape of the ski in ways that affect performance.

The above referenced pending application Ser. No. 08/330,263 discloses a ski that avoids the perceived weight problems and the cycle time problems by molding the ski with separate upper and lower halves. The upper and lower halves include longitudinally extending ribs that are interdigitated with one another during assembly and that are dimensioned to provide longitudinally extending voids that contribute to a lower weight for the ski. Engaged portions of the upper and lower halves are disclosed as being sonic welded to one another to provide a structurally rigid ski. It was found, however, that many plastics which yield good skiing performance are not well suited to sonic welding. Conversely, many sonically weldable plastics do not exhibit the desired strength and friction characteristics. Furthermore sonic welding can be costly and extensive quality control is required.

In addition to the long manufacturing cycle for cooling the thick plastic in GAUER brand skis, the installation of edges on the above described GAUER skis also has been time consuming. In particular, the above described GAUER skis are molded with corner channels for receiving metallic edges of generally rectangular cross-sectional shape. Holes are bored through the edges at approximately one inch spacings along the length of the edges. Screws then securely mount the edges into the corner channels in the prior art GAUER skis. Unlike prior art conventional skis, proper alignment of edges on the GAUER skis is important for optimum balletic maneuvering. In particular, the edges extend in tangential relationship to the arcuately convex plastic bottom of the prior art GAUER ballet skis. Improper alignment of the screws could position the metallic edges into non-tangential alignment with the bottom surface and/or could cause the screws to protrude from the plastic along the side. Acceptable results can be achieved only by employing skilled artisans to manually drill each hole and install each screw.

The prior art has included many plastic forming techniques that have been used to make products other than skis. For example, blow molding and rotational molding have been used to make various hollow articles. Blow molding functions by closing a mold of selected shape around a tube of flowable plastic. Air pressure is then directed into the plastic tube and urges the plastic outwardly to conform to the precise shape of the mold. Blow molding is used, for example, to make plastic beverage containers. A low cycle time and a relatively inexpensive mold are among the many advantages of blow molding. However, blow molded plastic products are limited to very thin plastic walls that are likely to deform significantly in response to forces, such as forces encountered while performing balletic maneuvers on a ski. Rotational molding involves placing a flowable plastic inside a mold, and rotating the entire mold about an axis. Centrifugal force urges the plastic outwardly in the rotating mold, and hence causes the plastic to assume the shape of the mold cavity. Rotational molding can achieve slightly thicker walls than blow molding. However, it is believed that the walls of a rotationally molded product are still too thin to withstand pressures encountered during skiing without significant deformation.

The prior art also includes dual molding where a first portion of an object is molded and cooled. A second portion of the object is then molded to at least partly engage the first portion. This technique may be used to avoid overly complex and costly molds that would otherwise be required for producing a complicated part with a single mold. This technique also may be used where different types of plastic are needed to meet different performance specifications. For example dual molding may be used to make a laminated pipe fitting where the inner layer is contacted by a first chemical and the outer layer is contacted by a second chemical.

In view of the above, it is an object of the subject invention to provide ballet skis and method of making ballet skis that can reduce manufacturing cycle time.

It is another object of the subject invention to provide light weight ballet skis that will exhibit acceptable structural integrity during use.

It is another object of the subject invention to provide an improved method for mounting metallic edges onto a ballet ski.

SUMMARY OF THE INVENTION

The subject invention is directed to a ski having at least one internal cavity, at least one internal support structure adjacent and/or defining the internal cavity and an outer shell surrounding both the cavity and the internal support structure. The ski may further include an internally disposed thin metal plate adjacent the outer shell. The outer shell is formed from a plastic selected for exhibiting desirable skiing performance and an appropriate aesthetic appearance. The internal support structure is in supporting engagement with at least selected portions of the outer shell to ensure structural integrity for the ski and to prevent significant dimensional changes in response to forces exerted during skiing. The internal support structure and/or the metal plate may further provide an acceptable anchor for mounting bindings onto the skis. The internal cavity may comprise at least one air pocket defined by portions of the internal support structure and/or the outer shell. The internal cavity may be filled with a light weight material such as a foamed plastic. The light weight material may define an insert about which the internal support structure and/or the outer shell are subsequently formed. Alternatively, light weight filler material may be injected into a previously formed internal cavity in the outer shell and/or internal support structure of the ski.

The internal support structure and the outer shell of the ski preferably are formed by injection molding, but blow molding, rotational molding vacuum molding or compressed foam may be employed for at least the internal support structure. The outer shell and the internal support structure may be unitary with one another and may merely define functionally separate portions of a single unitarily molded portion of the ski, as explained further below.

The invention is further directed to a method for making the above described skis. One preferred method includes an initial step of forming an internal support structure. The internal support structure may be hollow, and hence may define and include the internal cavity of the ski. The internal support structure may be formed by blow molding, rotational molding or injection molding. A preferred method includes separate injection molding of upper and lower halves of the internal support structure and then securing the halves together to define the internal cavity. The internal support structure may be molded to include corrugations or ribs at internal positions on the ski for further contributing to structural support and dimensional integrity during skiing. These corrugations or ribs may be disposed to coincide with locations used for anchoring bindings on the ski. The outer surface of the internal support structure may be molded to facilitate molded plastic engagement by the outer shell as explained herein. The method may proceed by placing the internal support structure into the mold for the outer shell. Portions of the internal support structure may define positioning legs that extend into contact with portions of the injection mold to precisely position the internal support structure relative to the outer shell. Plastic for the outer shell then may be injected about the internal support structure.

The above described methods may further include mounting metal edges into side regions of the bottom surface of the ski. The mounting of the edges may be by the above described drilling and screwing procedures. However, the mounting of edges may be carried out by snapping edges into the ski. In this latter regard, the bottom surface of the ski may be formed with a corner channel for receiving the metallic edges. The ski may further be molded to include a locking groove extending parallel to the adjacent side of the ski and toward the top surface of the ski. As a further manufacturing step, an anchoring groove may be machined into the ski after completion of the molding processes. The anchoring groove may extend into the corner channel substantially parallel to the bottom surface of the ski. This additional manufacturing step may be carried out by a router-like tool with guides for precisely tracking the arcuately convex bottom surface of the ski. The metal edge may include a generally rectangular cross-sectional portion having two flanges projecting therefrom. One flange may be dimensioned to be inserted into the machined anchoring groove in the bottom surface of the ski. The other flange may be dimensioned to snap into the molded locking groove after sufficient insertion of the first flange into the machined anchoring groove. This slidable and snapped insertion of the edges into the grooves can completely avoid the manufacturing inefficiencies of the above described drilling and screwing processes of the prior art ballet skis, while further avoiding the difficulties associated with laminating and gluing the edges into the bottom surface for a conventional prior art ski.

DETAILED DESCRIPTION OF THE PREFERRED EMBODIMENTS

Figure 1:
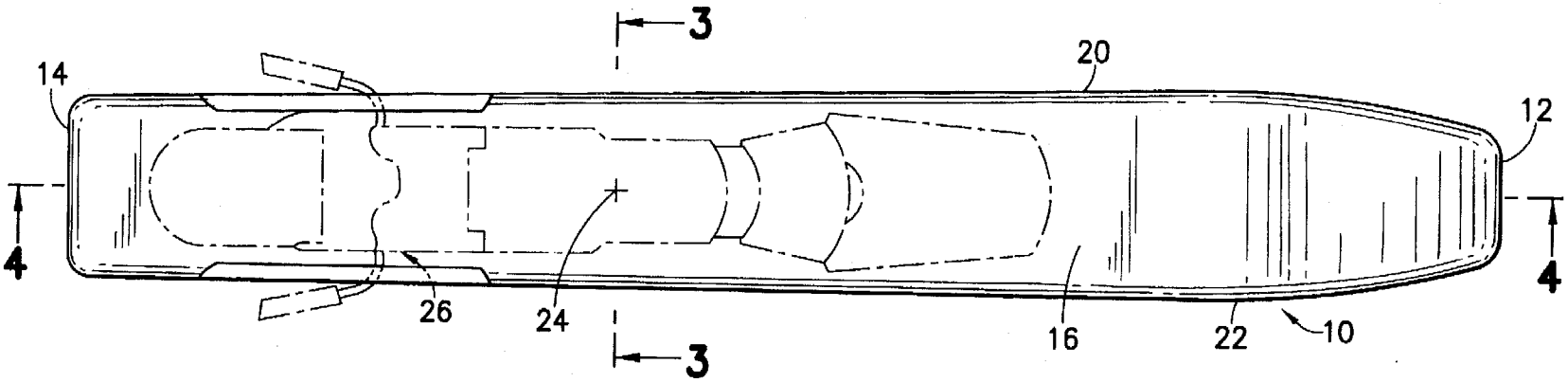
FIG. 1 is a top plan view of a ski in accordance with the subject invention.
Figure 2:
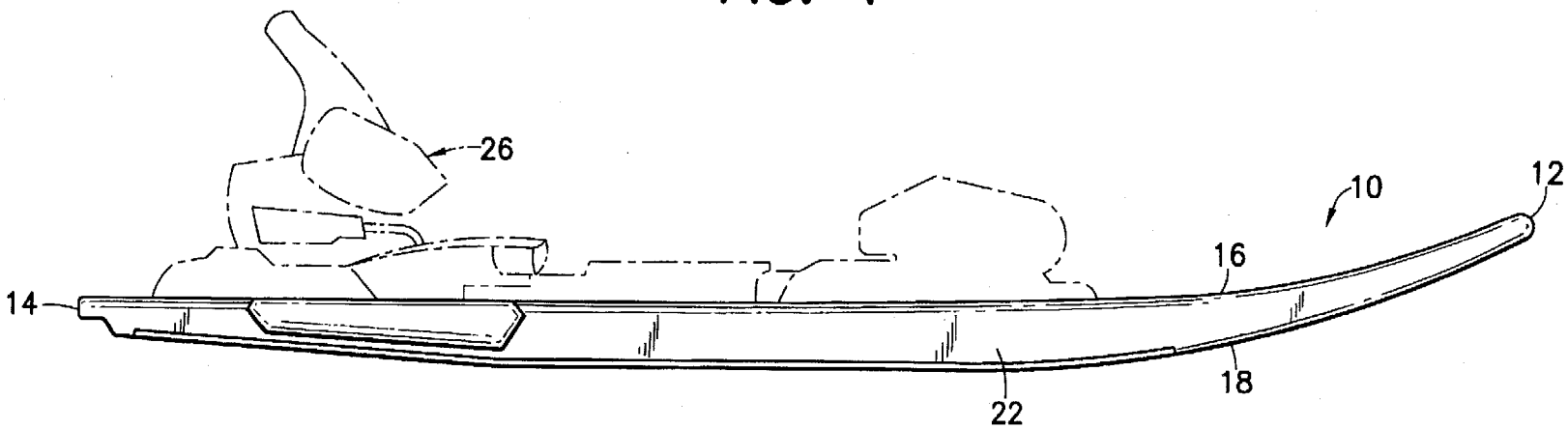
FIG. 2 is a side elevational view of the ski shown in FIG. 1.

A ski in accordance with the subject invention is identified generally by the numeral 10 in FIGS. 1–4. The ski 10 has opposed front and rear ends 12 and 14, opposed top and bottom surfaces 16 and 18 and opposed longitudinal sides 20 and 22. The ski includes a center of gravity 24 which is clearly marked on the top surface 16. A binding apparatus 26 may be mounted to the top surface 16 and centered on the center of gravity 24. As in prior art skis, the binding apparatus 26 is secured to the top surface 16 of the ski 10 by a plurality of screws passing through the binding apparatus 26 and securely engaged into the ski 16.

A ski in accordance with the subject invention may take many different external shapes. However, preferred configurations are described and illustrated in considerable detail in the above-identified patents and applications to Richard Gauer.

Figure 4:
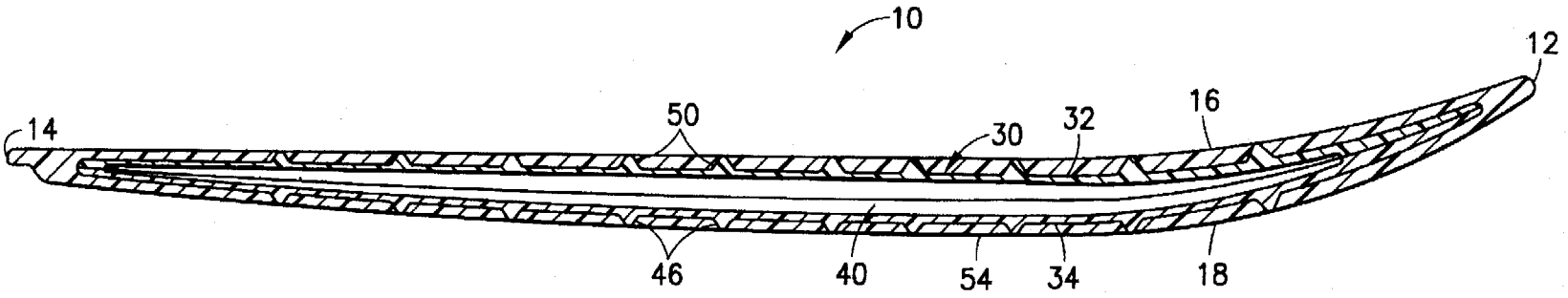
FIG. 4 is a cross-sectional view taken along line 4—4 in FIG. 1.
Figure 5:
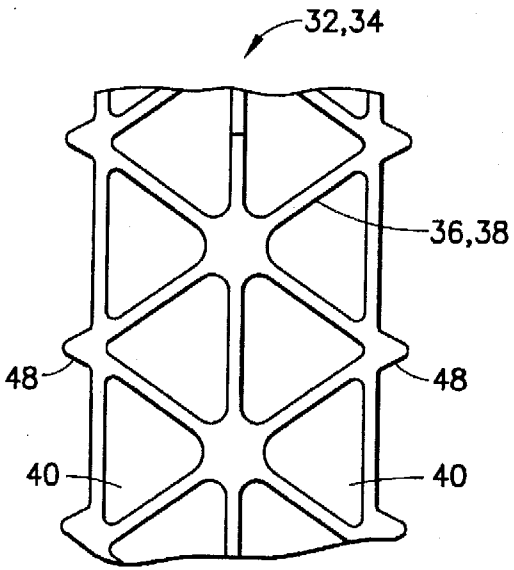
FIG. 5 is a top plan view of a portion of the bottom half of an alternate internal support structure.
Figure 3:
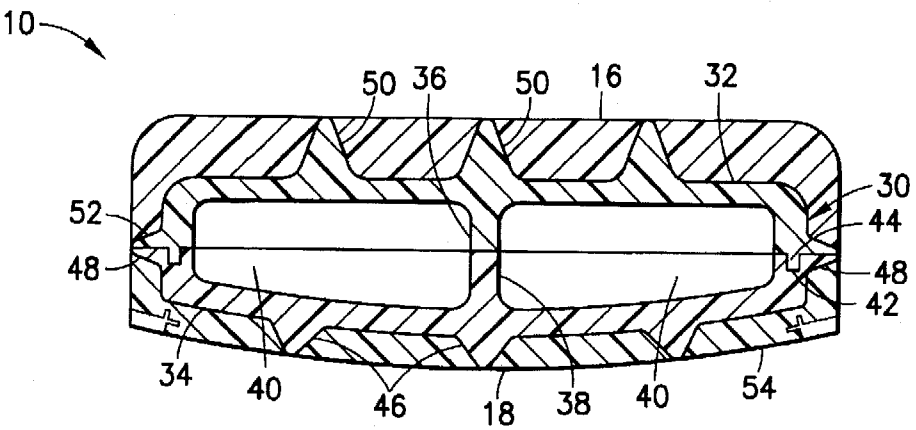
FIG. 3 is a cross-sectional view taken along line 3—3 in FIG. 1.

With reference to FIGS. 3 and 4, the ski 10 is formed to include an internal support structure 30 formed from upper and lower injection molded halves 32 and 34 which are secured together. The upper and lower halves 32 and 34 are provided with inwardly facing reinforcement ribs 36 and 38 respectively disposed for supporting engagement with one another on the assembled internal support structure 30. Reinforcement ribs 36 and 38 are disposed to define internal cavities 40 between the upper and lower halves 32 and 34. More particularly, the ribs 36 and 38 may extend longitudinally to define elongate cavities 40 as shown in FIGS. 3 and 4. Alternatively, the ribs 36, 38 may define a honeycomb, as shown in FIG. 5.

The opposed upper and lower halves 32 and 34 are securely locked into the assembled condition shown in FIGS. 3 and 4. More particularly, the lower half 34 is molded with a plurality of locking apertures 42 in the upper surface thereof, and the upper half 32 of the internal support structure 30 is provided with a plurality of locking pins 44 disposed and dimensioned for locking into the apertures 42 to securely hold the opposed halves 32 and 34 of the internal support structure 30 in an assembled condition.

The lower half 34 of the internal support structure 30 is provided with a plurality of bottom positioning legs 46 projecting downwardly therefrom and with a plurality of lateral positioning legs 48 projecting transversely therefrom. The lateral positioning legs 48 are disposed to lie on the parting line of the mold used to form the lower half 34 of the internal support structure 30. The upper half 32 of the internal support structure 30 similarly is provided with a plurality of top positioning legs 50 and lateral positioning legs 52. The positioning legs 46–52 are used to precisely position internal support structure 30 within a mold cavity used to form an outer shell as explained further below. The bottom positioning legs 46 preferably are slightly shorter (⅛"–3/16") than the top positioning legs 50 (¼"–⅜"). Thus, the outer shell formed around the internal support structure 30 will be thicker in portions adjacent the top surface 16 of the ski 10. The greater thickness can be helpful for ensuring a secure mounting of bindings 26 onto the ski 10. The lateral legs 48 and 52 may be disposed to register with one another or may be offset from one another. The outer surface regions of the internal support structure 30 preferably have a textured finish to permit gripping by the outer shell.

The assembled internal support structure 30 is positioned within an injection mold cavity having a shape selected for the desired external configuration of the ski 10 as described and illustrated in the above referenced Gauer patents and applications. Precise positioning is ensured by the positioning legs 46–52. Certain positioning legs may be dimensioned to engage apertures in the mold to hold the internal support structure 30 in position prior to closing the mold. The mold cavity is then filled around the internal support structure 30 to form an outer shell 54.

Figure 6:
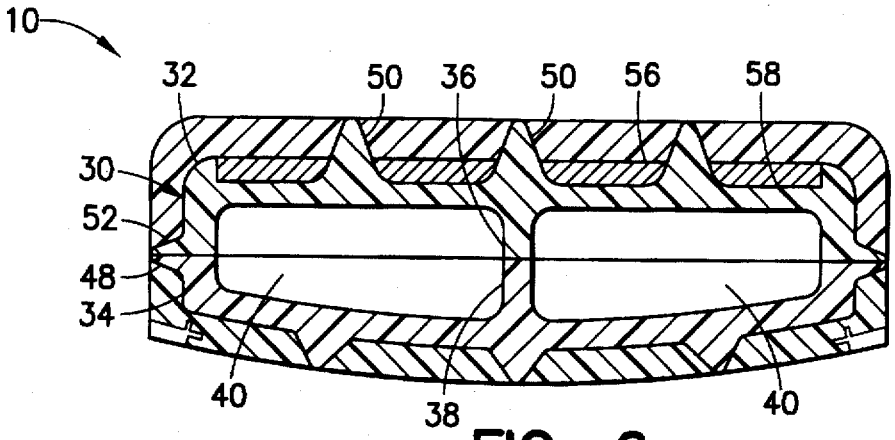
FIG. 6 is a cross-sectional view similar to FIG. 3, but showing the second embodiment of the ski.

In a second embodiment, additional strength may be provided in proximity to the top surface 16 of the ski 10. For this embodiment, a thin metallic plate 56 may be positioned on a top side 58 of the upper half 32 of the internal support structure 30 as shown in FIG. 6. The plate 56 may have a thickness of approximately ⅛"–3/16" and may extend over portions of the ski 10 to which the binding 26 may be mounted. The plate 56 has apertures that permit the top positioning legs 50 to pass therethrough.

The ski 10 offers several significant manufacturing efficiencies. For example, the internal cavities 40 result in a significant weight reduction for the finished ski 10. Additionally, although the ski 10 requires more molds than the prior art skis identified above, all molded parts have relatively thin walls, and a much faster cycle time can be achieved.

In an alternate embodiment of the ski 10, the internal support structure 30 may be unitarily molded by, for example, blow molding or rotational molding. These molding techniques also lead to fairly short cycle times and enable a hollow product to be formed. However, blow molding and rotational molding are not well suited to the formation of precise positioning legs 46–52, nor the formation of internal ribs 42 for reinforcement. These potential draw backs of blow molding and rotational molding can be offset by selecting wall thicknesses to provide adequate structural support without reinforcing ribs and to provide separate positioners for accurately locating the internal reinforcement within the mold cavity used to form the outer shell 54. For example, positioners may be part of the mold used to form the outer shell 54. This necessarily would leave holes in the outer shell 54 that would require filling after removal of the ski 10 from the mold. As a further alternate, sandwich molding may be employed where two unmixable plastics may be injected into the same mold. A first plastic may be foamed to define the internal support structure 30 and with bubbles in the foam defining the internal cavity. The second plastic will not mix with the foam and will be injected to form the outer shell 54.

Figure 7:
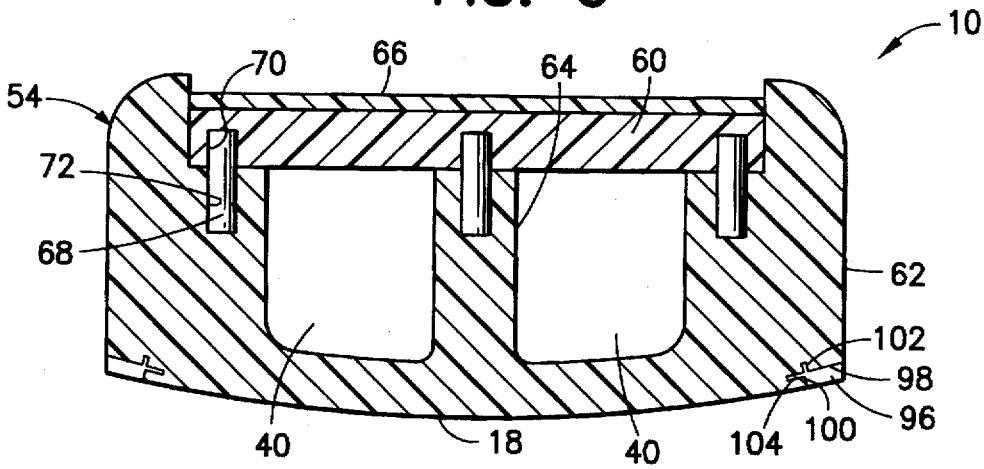
FIG. 7 is a cross-sectional view similar to FIG. 3, but showing a third embodiment of the ski.
Figure 8:
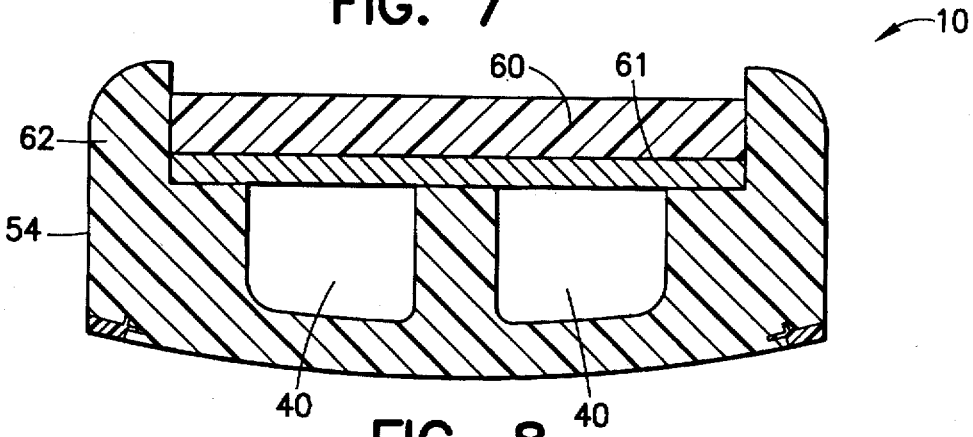
FIG. 8 is a cross-sectional view similar to FIG. 3, but showing a fourth embodiment of the ski.

Third and fourth embodiments of the ski 10 are illustrated in FIGS. 7 and 8. The ski 10 is similar to the ski in the preceding figures in that it includes internal cavities 40. In this embodiment, the outer shell 54 is formed from opposed top and bottom halves 60 and 62 and the internal support structure is defined as a unitary projection 64 from the bottom half 62. The lower half 62 is formed with a recessed seat into which the upper half 60 is received. The upper half 60 of the outer shell 54 may be recessed to form a protected region for receiving an applique 66 with safety information or decoration. This construction is similar to the construction depicted in the above referenced pending application with a few notable exceptions. First, the seam between upper and lower halves is completely surrounded and protected. Second to achieve larger voids and hence lighter weight without reducing strength, the ski 10 may further include a metal plate 61 between the opposed top and bottom halves 60 and 62 of the outer shell 30 as shown in FIG. 8. Third, to avoid costs, time and potential difficulties associated with sonic welding, the ski 10 is provided with mechanical connectors in the form of pins 68 force fit into apertures 70, 72 as shown in FIG. 7 or screws as shown in FIG. 8. As shown in FIG. 7, the top and bottom halves 60 and 62 have apertures 70 and 72 respectively, and the pins are separate members. In other embodiments, however, the pins may be unitarily molded with either the top or bottom half 60 or 62, and may be disposed and dimensioned to be lockingly received within the apertures 70, 72 in the other half.

Figure 9:
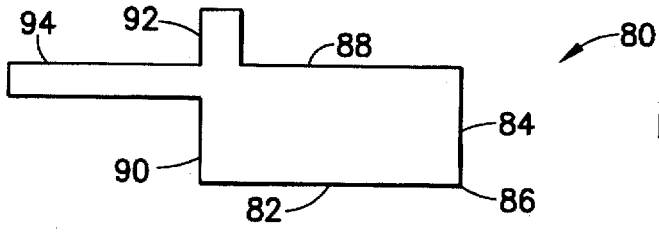
FIG. 9 is an end elevational view of a metallic edge for use with a ski groove as shown in FIGS. 1, 7 and 8.

The ski 10 of the subject invention includes metal edges 80 secured to portions of the bottom surface 18 adjacent the sides 20 and 22 of the ski 10. The metal edges 80 are formed from strips of metal extruded or cold rolled to the shape depicted in FIG. 9. More particularly, each metal edge 80 includes a bottom surface 82 and a side surface 84 which meet at a corner 86. Each edge 80 further includes a top mounting surface 88 and a side mounting surface 90 which seat against correspondingly configured and dimensioned surfaces on the ski 10. Each metallic edge 80 further includes a vertical locking flange 92 and a horizontal anchoring flange 94. The horizontal anchoring flange 94 extends substantially parallel to the bottom surface 82 and the top mounting surface 88, and substantially in the same plane as the top mounting surface 88. The vertical locking flange 92 lies substantially in the plane of the side mounting surface 90 and substantially parallel to the side mounting surface 90 and the side surface 84.

To accommodate the edge 80, the ski 10 is molded with a corner channel 96, having a horizontal mounting face 98 and a vertical mounting face 100 as shown in FIG. 7. Additionally, the ski 10 is molded to include a vertical locking groove 102 extending substantially vertically and continuously from the vertical mounting edge 100. The vertical locking groove 102 is readily moldable when the parting line between opposed halves of the injection mold extends substantially parallel to the top surface 16 of the ski 10. After removal of the ski 10 from the mold, and after appropriate cooling, a router-like tool is used to machine a horizontal anchoring groove 104 into the plastic of the ski 10 and parallel to portions of the bottom surface 18 adjacent the corner channel 96. In this regard, the bottom surface 18 of the ski is arcuately convex at most locations, and hence the channel 104 follows the convex shape. Additionally, the horizontal groove 104 is disposed to substantially align with the horizontal mounting surface 98 of the corner channel 96.

The edge 80 is mounted into the corner channel 96 by urging the horizontal flange 94 into the horizontal groove 104 that had been machined into the plastic of the ski 10. More particularly, this movement of the metal edge 80 is carried out to move the edge 80 from the side of the ski toward the middle. This mounting of the metallic edge 80 will initially cause a deflection about the horizontal anchoring flange 94 as the vertical locking flange 92 slides along the horizontal mounting surface 98 of the corner channel 96. After sufficient movement, however, the vertical locking flange 92 will align with the vertical locking groove 102 and will snap into engagement. This secure retention of the flanges 92 and 94 in the grooves 102 and 104 respectively will securely retain the edge 80 in the corner channel 96 without screws as in the prior art Gauer skis and without adhesive and lamination as in the prior art conventional skis.

While the invention has been described with respect to a preferred embodiment, it is apparent that various changes can be made without departing from the scope of the invention as defined by the appended claims.

We claim:

1. A ski comprising: an internal support structure and an outer shell surrounding said internal support structure, said internal support structure comprising upper and lower halves secured together and defining a plurality of internal cavities within said ski, said internal support structure having an outer surface with a plurality of outwardly protecting positioning legs, said outer shell being unitarily formed around said internal support structure and surrounding and engaging said positioning legs.

2. The ski of claim 1, wherein said internal cavities are defined by said internal support structure, and wherein said outer shell surrounds and engages said internal support structure.

3. The ski of claim 1, further comprising an internally disposed metallic plate.

4. The ski of claim 1 having opposed top and bottom surfaces, said internal support structure having a first plurality of said positioning legs extending towards said bottom surface and a second plurality of said positioning legs extending toward said top surface, the positioning legs of said second plurality being longer than the positioning legs of said first plurality for providing a greater thickness on portions of said outer shell adjacent said top surface of said ski.

5. The ski of claim 1, wherein said outer surface of said internal support structure is textured for enhancing engagement of said internal support structure by said outer shell.

6. The ski of claim 1, wherein said outer shell comprises upper and lower sections, said internal support structure being unitary with one of said upper and lower sections and being dimensioned and configured for engaging the other of said upper and lower sections of said outer shell and for defining said internal cavity.

7. The ski of claim 6, wherein said lower section of said outer shell includes a recessed seat in an upper portion thereof, said upper section of said outer shell being securely received in said seat of said lower section.

8. The ski of claim 7, wherein the upper section of said outer shell is recessed below upper portions of said lower section, and wherein said ski further comprises an applique affixed to outwardly facing portions of said upper section of said outer shell, said applique being provided with indicia imprinted thereon.

9. The ski of claim 7, further comprising a metal plate between said upper and lower sections of said outer shell.

10. The ski of claim 1 having a front end, a rear end, opposed top and bottom surfaces and opposed sides, portions of said outer shell disposed along said bottom surface and adjacent said sides including corner channels, anchoring grooves extending into said outer shell at each said corner channel and extending substantially parallel to said bottom surface of said ski, locking grooves extending into said outer shell at each said corner channel and extending parallel to said sides of said ski, said ski further including metal edges secured into said corner channels, each said metal edge including an anchoring flange slidably received within one said anchoring groove and a locking flange lockingly snapped into one said locking groove.

* * * * *